US005711978A

United States Patent [19]

Breen et al.

[11] Patent Number: 5,711,978

[45] Date of Patent: Jan. 27, 1998

[54] FRESH MEAT PACKAGING

[75] Inventors: Dennis J. Breen, Pleasant Hill; Lawrence Wilson, Dixon, both of Calif.

[73] Assignee: Transhumance, Davis, Calif.

[21] Appl. No.: 761,783

[22] Filed: Dec. 6, 1996

Related U.S. Application Data

[62] Division of Ser. No. 543,886, Oct. 16, 1995, Pat. No. 5,667,827.

[51] Int. Cl.[6] ..... B65D 85/00

[52] U.S. Cl. ..... 426/129; 426/106; 426/108; 426/118; 426/315; 426/395; 426/396; 426/410

[58] Field of Search ..... 426/106, 108, 426/118, 119, 129, 312, 315, 395, 396, 410

[56] References Cited

U.S. PATENT DOCUMENTS

| | | |
|---|---|---|
| 2,859,122 | 11/1958 | Maturi et al. . |
| 3,074,798 | 1/1963 | Palmer . |
| 3,442,433 | 5/1969 | Lombardi et al. . |
| 3,648,428 | 3/1972 | Colburn . |
| 4,058,953 | 11/1977 | Sanborn, Jr. et al. . |
| 4,548,824 | 10/1985 | Mitchell et al. . |
| 4,683,139 | 7/1987 | Cheng . |
| 4,685,274 | 8/1987 | Garwood . |
| 4,702,377 | 10/1987 | Grone . |
| 4,801,347 | 1/1989 | Garwood . |
| 4,812,320 | 3/1989 | Ruzek . |
| 4,833,862 | 5/1989 | Bortolani et al. . |
| 4,840,271 | 6/1989 | Garwood . |
| 4,919,955 | 4/1990 | Mitchell . |
| 4,939,322 | 7/1990 | Hahn . |
| 4,987,725 | 1/1991 | Gill . |
| 5,025,611 | 6/1991 | Garwood . |
| 5,103,618 | 4/1992 | Garwood . |
| 5,115,624 | 5/1992 | Garwood . |
| 5,129,512 | 7/1992 | Garwood . |
| 5,155,974 | 10/1992 | Garwood . |
| 5,226,531 | 7/1993 | Garwood . |
| 5,323,590 | 6/1994 | Garwood . |

*Primary Examiner*—Lien Tran
*Attorney, Agent, or Firm*—Feix & Feix

[57] ABSTRACT

A package for packaging fresh meat in a substantially oxygen-free atmosphere, whereby the packaging provides for a prolonged shelf life of the packaged meat products so that the meat will bloom to a desired red color when the packaging is opened. The packaging includes a packing tray which is sized for receiving a piece of fresh meat of predetermined cut. The tray is overwrapped with a web of clear plastic wrapping material. The overwrapped tray is ventilated to ensure gas communication between enclosed regions of the overwrapped tray and the outside ambient without blockage due to run off juices from the meat product or shifting of the meat product within the tray during transport. A number of similarly ventilated overwrapped trays are then placed within an outer barrier bag which is first evacuated of normal atmosphere and then flushed with a preservation-enhancing gas. The outer barrier bag is then sealed. Upon opening of the outer barrier bag, exposure to oxygen causes the packaged meat products to bloom to a desired fiery red color. Upon removal from the outer barrier bag, the ventilated overwrapped trays are ready for retail case-ready display without the need for repackaging or cosmetic repair.

11 Claims, 3 Drawing Sheets

FRESH MEAT PACKAGING

This is a divisional of application Ser. No. 08/543,886 filed on Oct. 16, 1995, now U.S. Pat. No. 5,667,827.

TECHNICAL FIELD

The present invention relates to improvements in fresh meat packaging, and in particular, to an improved retail case-ready packaging and a method of packaging fresh meat in a substantially oxygen-free atmosphere, whereby the packaging provides for a prolonged shelf life of the packaged meat products so that the meat will bloom to a desired red color when the packaging is opened.

BACKGROUND OF THE INVENTION

In accordance with known case-ready fresh meat packaging techniques, fresh meat products are processed from primals into various cuts at the meat processing plant where they are then packaged prior to shipment to the retail market. The packaging step typically includes placing the cuts within a styrofoam tray which is overwrapped with a non-barrier clear plastic film. The overwrapped trays are then placed within a vacuum packed and gas-flushed barrier bag. The above described packaging technique is typically done in the normal nitrogen-oxygen atmosphere of the meat packing facility. Such packaging typically only has a shelf life of between ten to fifteen days. This relatively short shelf life is due, in large part, to the prolonged exposure of the meat to the residual oxygen that is present in the packaging.

Prolonged exposure of fresh meat to oxygen is known to cause bacterial decay and discoloration of the meat. Also, conventional fresh meat packaging is very sensitive to temperature variations, thus requiring careful handling of the packaged meat products during transport to the retail display case.

In the case of red meat, in particular, prolonged exposure to oxygen causes the conversion of myoglobin meat pigmentation to the grey or brown metmyoglobin, which is generally unacceptable for the average retail customer. However, a controlled exposure of the meat product to oxygen is necessary in order to oxygenate the meat pigment to bright red oxymyglobin. This creates the desired red "bloom" of the meat which the average retail customer associates with freshness and wholesomeness.

It is known in the art to package fresh meat in a modified atmosphere environment whereby the packaging is flushed with a preservation-enhancing gas mixture, typically containing a bacterial inhibitor such as carbon dioxide. In the case where styrofoam packing trays are used, however, residual oxygen is trapped inside the porous openings of the styrofoam tray material and eventually diffuses out over time, thereby causing premature discoloration and bacterial decay of the meat.

U.S. Pat. Nos. 4,685,274 and 5,522,53, both issued to Anthony J. M. Garwood, disclose a packaging system for fresh meat which utilizes a specially constructed retail case-ready tray for prolonging the shelf life of the fresh meat product. Garwood teaches that the tray may be constructed of a gas barrier plastic material. The packaging system of Garwood further includes a laminated web of gas permeable clear flexible plastic wrap material which seals the meat within the tray and a lid which forms a domed enclosure over the laminated web. In use, the packaging is evacuated of normal atmosphere and is flushed with a gas mixture of carbon dioxide and nitrogen to preserve the contents. When the dome is pulled off, oxygen is allowed to contact the meat and the product blooms.

Under ideal storage conditions (ie., where storage temperature is maintained between 29° F. and 32° F.), the Garwood packaging system is able to achieve a shelf life in a range of about twenty to forty days. The maximum shelf life for the Garwood packaging system, however, is determined by the maximum amount of carbon dioxide that can be practicably stored within the domed enclosure, which is typically only 60–70% by volume of the total gas mixture. Nitrogen, or some other like inert gas, must be used as a filler, otherwise the packaging will implode as the meat absorbs the carbon dioxide within the limited volume domed enclosure.

Another drawback of the Garwood packaging system is that the addition of the special lid for forming the domed enclosure increases the overall cost of the packaging over conventional plastic overwrapped trays. For many retailers, the benefit of the increased shelf life does not outweigh the additional cost incurred by the packaging. A less expensive packaging which also affords increased shelf life would be desirable.

Further, it would be desirable to be able extend the shelf life of the packaged meat beyond the present maximum shelf life of about twenty to forty days, and preferably, up to a maximum shelf life of sixty or even ninety days.

SUMMARY OF THE INVENTION

It is therefore a principal object of the present invention to provide an inexpensive, retail case-ready packaging for perishable products, such as fresh meat, which provides a maximum shelf life that is considerably greater than that which is presently attainable by the fresh meat packagings of the prior art.

Broadly stated, the present invention, to be described in greater detail below, is directed to a method of packaging fresh meat for retail case-ready display in a substantially oxygen-free atmosphere. The packaging method of the present invention provides a prolonged shelf life for the packaged meat products in a range of from about forty to about ninety days, after which the meat still blooms up to a desired fiery red color upon exposure of the packaged meat product to oxygen.

In accordance with one aspect of the invention, a plastic overwrapped packing tray is provided for receiving a cut of meat. In use, the overwrapped tray is received within a barrier outer bag which is first evacuated of normal atmosphere and is then flushed with a preservation-enhancing gas, after which it is then sealed. The overwrapped tray is "ventilated" with strategically placed perforations which allow the preservation-enhancing gas to penetrate all enclosed regions of the ventilated overwrapped tray without clogging due to run off juices from the meat or shifting of the meat inside the tray during transport. In this way, the preservation-enhancing gas is effectively absorbed by the packaged meat product.

Once the packaged meat product arrives at the retailer, the individually overwrapped trays are removed from their barrier outer bags to allow oxygen to enter through the perforations of the ventilated overwrapped tray. The oxygen contact with the meat causes it to bloom up so that the pigmentation of the meat changes to a desired bright red color.

In accordance with an advantageous aspect of the invention, the placement of the perforations in the ventilated overwrapped tray are not readily visible to the casual observer. Also, the top web of plastic wrap which overlies the meat product is not pierced so that the retailer does not need to worry about lining up the ventilated overwrapped trays in the retail display case in any particular way so that the product does not dry out or look as though it has been tampered with.

Also, since the top web of the ventilated overwrapped tray is not pierced, the workers at the meat packing plant do not have to be conscious of leaving a void space beneath the top web so that the meat product does not inhibit the vacuum and gas flushing steps.

Methods and apparatus which incorporate the features described above and which are effective to function as described above constitute specific objects of this invention.

Other and further objects of the present invention will be apparent from the following description and claims and are illustrated in the accompanying drawings, which by way of illustration, show preferred embodiments of the present invention and the principles thereof and what are now considered to be the best modes contemplated for applying these principles. Other embodiments of the invention embodying the same or equivalent principles may be used and structural changes may be made as desired by those skilled in the art without departing from the present invention and the purview of the appended claims.

BRIEF DESCRIPTION OF THE DRAWING VIEWS

DETAILED DESCRIPTION OF THE PREFERRED EMBODIMENTS

Figure 1:
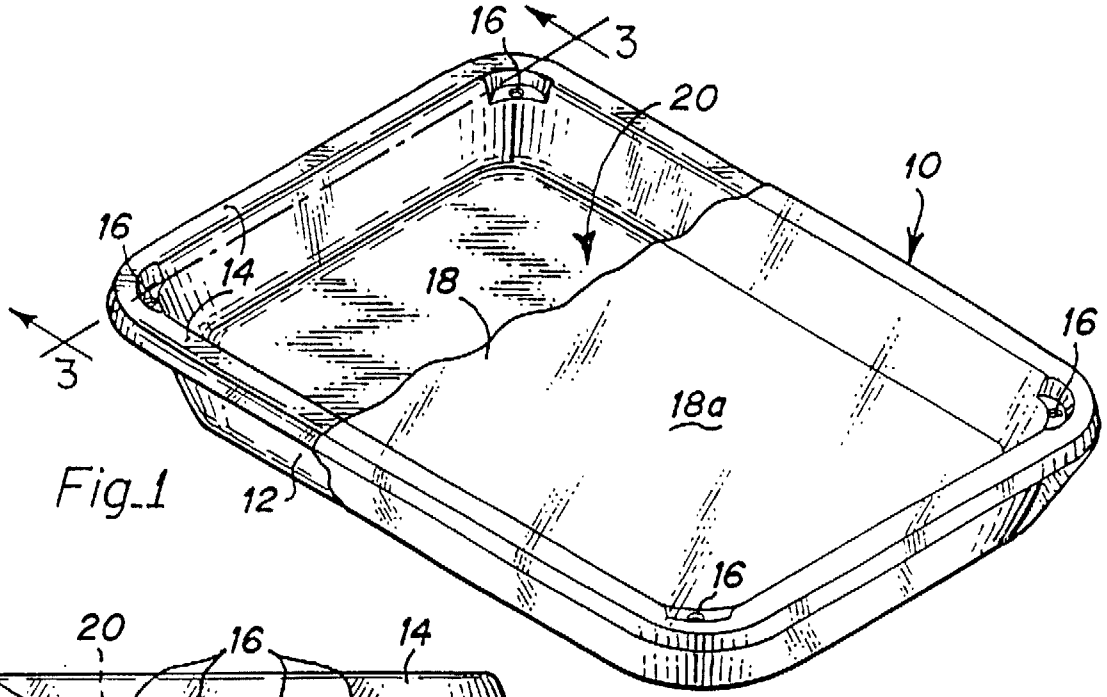
FIG. 1 is an isometric perspective view of a ventilated overwrapped packing tray in accordance with the present invention.

An improved fresh meat packaging constructed in accordance with one embodiment of the present invention is designated generally by reference numeral 10 in FIG. 1.

The packaging 10 includes a packing tray 12 which is sized for receiving a piece of fresh meat of predetermined cut (not shown). The tray 12 is preferably made from a material which is impermeable to or does not retain residual oxygen. Preferred materials of construction for the tray 12 would include, but not be limited to, sturdy thermo-formable plastics such as polyvinyl and polystyrene.

The tray 12 includes side and end walls which are preferably flared upwardly and outwardly. An outwardly protruding continuous perimeter lip 14 is formed along the side and end walls of the tray 12. The tray 12 is provided with perforations, preferably in the form of a plurality of holes 16 that are disposed, spaced art, in upper portions of the side and end walls of the tray. As is seen in the embodiment of FIG. 1, four holes 16 are provided in the tray 12, one hole for each of the four corners of the tray 12.

Figure 3:
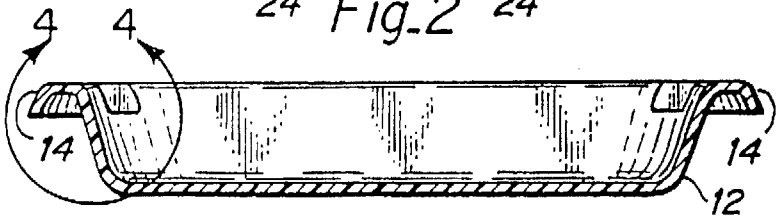
FIG. 3 is cross-section view of the ventilated overwrapped packing tray taken along the line and in the direction of arrows 3—3 of FIG. 1.
Figure 4:
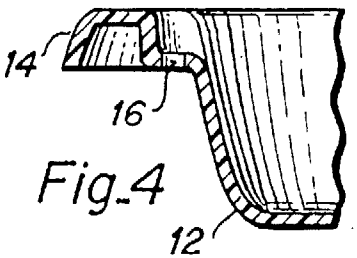
FIG. 4 is an enlarged fragmentary view of a corner region of the ventilated overwrapped packing tray shown encircled by arrows 4—4 of FIG. 3.

The placement of the holes 16 is selected to be sufficiently high along the walls to permit gas exchange through the walls of the tray without the possibility of clogging due to run off juices from the meat or shifting of the meat within the tray 12. To this end, one design scheme that may be employed for the formation and location of the holes 16 is shown in FIGS. 3 and 4. In this example, the corners regions of the tray 12 are formed with an upper recessed step portion in which the holes 16 are punched or otherwise formed.

Figure 2:
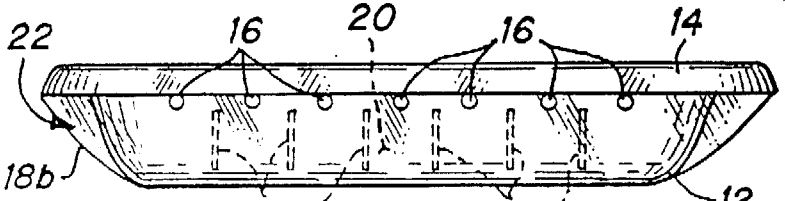
FIG. 2 is a side elevation view of a ventilated overwrapped packing tray in accordance with another embodiment of the present invention.

FIG. 2 shows a side elevation view of an embodiment similar to that shown in FIG. 1, except that the perforations in the tray 12 of FIG. 2 are in the form of several holes 16' disposed at spaced intervals and just under the perimeter lip 14 along each of the four walls of the tray 12.

In both of the embodiments shown in FIGS. 1 and 2, the tray 12 is overwrapped with a web of clear non-barrier film or plastic wrapping material 18. The plastic wrapping material 18, in combination with the outwardly protruding perimeter lip 14 of the tray 12, define two enclosed regions, including: a first enclosed region 20 formed by the enclosure of the hollow interior of the tray 12 by the overlying top web portion **18*a* of the plastic wrapping material 18 (see eg. FIG. 1); and a second generally annular-shaped enclosed region 22 formed by the outer perimeter overwrap portion 18*b* of the plastic wrapping material which extends from the outwardly projected perimeter lip 14 to the bottom of the tray 12** (see eg. FIG. 2).

A number of perforations, preferably in the form of vertical slits 24, are provided in the perimeter overwrap portion **18*b* of the plastic wrapping material 18. The slits 24, in combination with the holes 16, 16' in the tray 12, allow for gas communication between the first and second enclosed regions 20 and 22**, respectively, and the outside ambient atmosphere. The provision of the holes in the trays and the slits in the film material provide an overwrapped tray or packaging that is said to be "ventilated".

Figure 7:
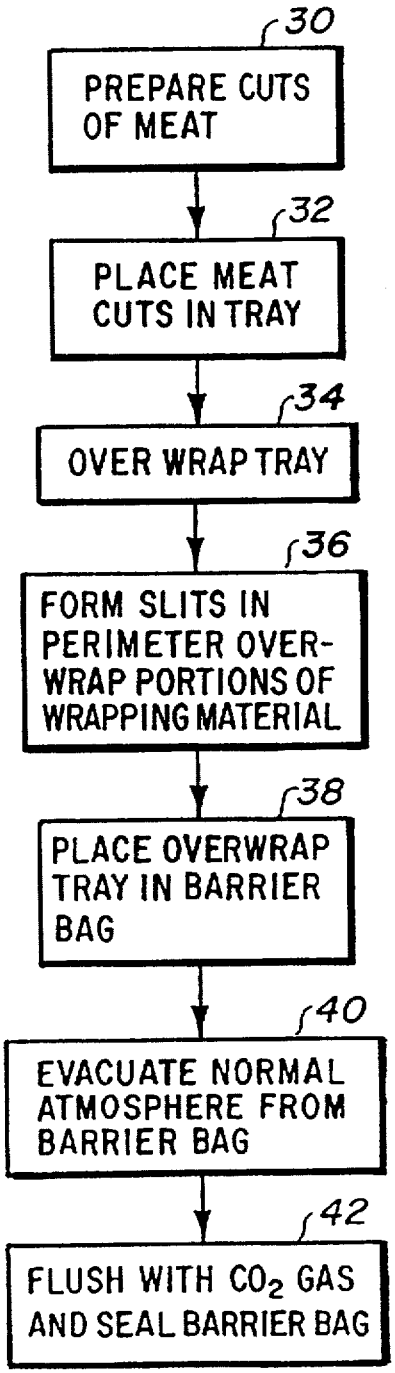
FIG. 7 is a block diagram illustrating the steps of the packaging methodology of the present invention.

Referring now to the block diagram of FIG. 7, the method steps involved in packaging fresh meat using the ventilated overwrapped tray of the present invention will now be described. The packaging method of the present invention is directed to packaging the fresh meat product in a substantially pure carbon dioxide environment, wherein the meat is allowed to age for a sufficient minimum length of time so that formation of lactic acid bacteria in the meat is allowed to flourish. As has been noted in the scientific literature, the high concentration of lactobacillus (lactic acid bacteria) in meat is believed to reverse brown pigment change in the meat and also is believed to contribute to a fiery red bloom of the meat. Lactobacteria do grow in a substantially pure $CO_2$ environment, even at temperatures as low as 29° F. and the enzymes secreted bring on an enhanced red color over time. We have also found that the desired aging period necessary to achieve a desired bright red bloom to be in the range of anywhere from a minimum of 4–5 days to about two weeks. The aging period selected depends on the color sensitivity of the cut portion of the meat. For example, shoulder cuts are more color sensitive than tender rib cuts and thus require more aging time to ensure a desired fiery red bloom.

In accordance with the packaging method of the present invention, the meat product is prepared into the selected cuts at step 30. The cuts are then placed within the trays 12 at step 32. Preferably, the trays 12 have already been perforated to include the holes 16 or 16' prior to step 32. The trays 12 are then overwrapped with the clear film or plastic wrapping material 18 at step 34. At step 36, the overwrap portions 18b of the plastic wrapping material 18 are perforated to form the slits 24.

Figure 5:
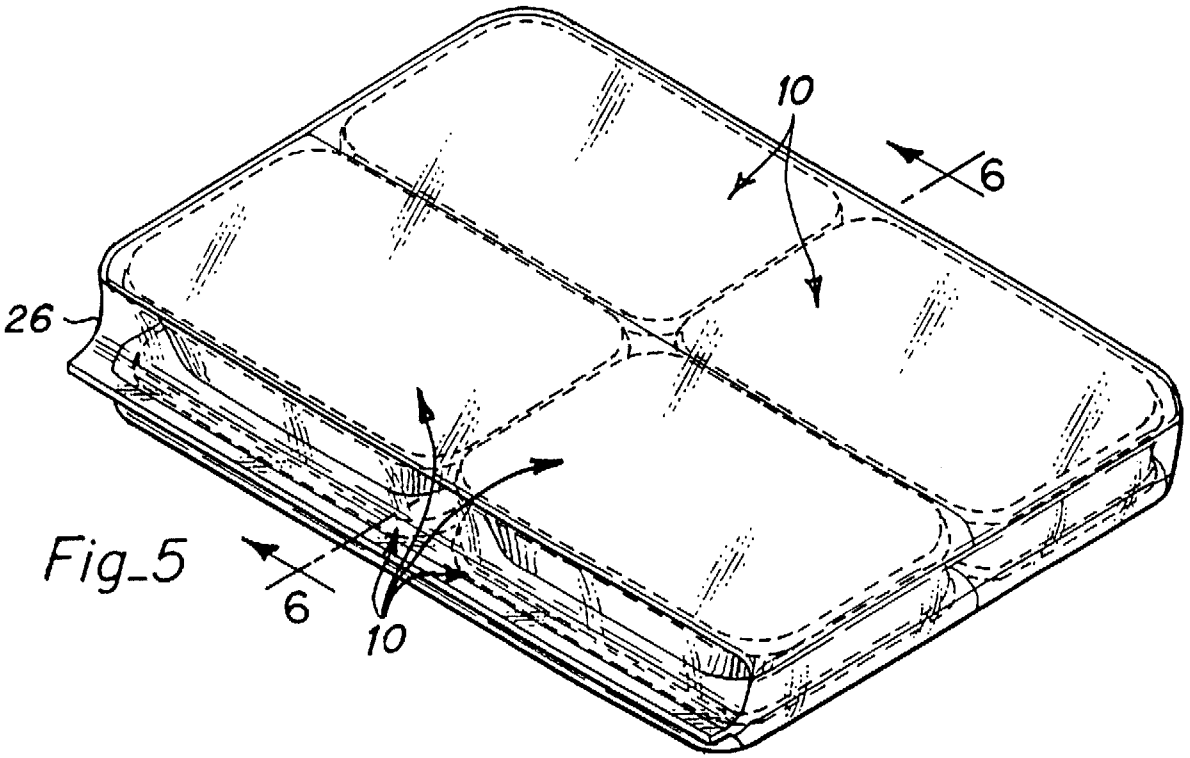
FIG. 5 is an isometric perspective view showing multiple units of ventilated overwrapped packing trays arranged in stacked fashion within a sealed outer barrier bag.
Figure 6:
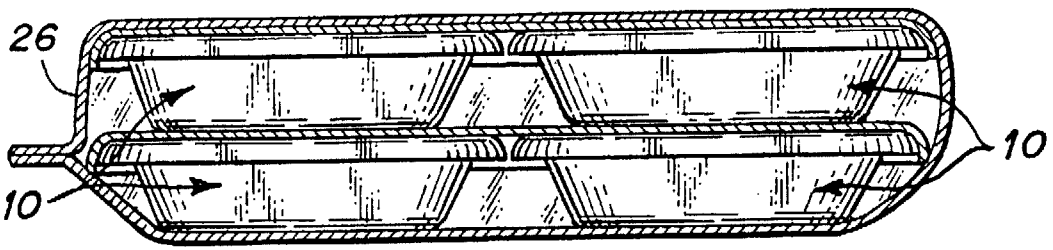
FIG. 6 is a cross-section view taken along the line and in the direction of arrows 6—6 of FIG. 5.

Referring now to FIGS. 5–6, a number of the individual packagings or ventilated overwrapped trays 10 are placed in stacked fashion within an outer barrier bag 26. The outer barrier bag is composed of a material which is essentially impervious to oxygen. The outer barrier bag 26 is evacuated of normal atmosphere at step 40 and is then flushed with a preservation-enhancing gas comprising substantially pure carbon dioxide at step 42. The outer barrier bag 26 is then sealed.

The slits 24 in combination with the holes 16 or 16' ensure that residual oxygen is removed from the first and second enclosed regions 20 and 22, respectively, of the ventilated overwrapped trays 10 during the evacuation or vacuum step 40. Also, the slits 24 and holes 16 or 16' ensure that carbon dioxide gas is allowed to effectively contact the packaged meat product so that it may be absorbed thereby in order to preserve and age the meat product.

Platter paper (not shown) or like buffering means may be placed between successive ones of the stacked ventilated overwrapped trays 10 and also between the upper disposed ventilated overwrapped trays 10 and the inner surface of the outer barrier bag 26. When used in this fashion, the platter paper advantageously protects against unsightly tears or punctures in the plastic wrapping material of the ventilated overwrapped trays 10 and also protects against punctures in the barrier outer bag which can sometimes result from the abrading action of protruding bones in the packaged meat products during handling and transport.

As an additional measure to ensure against the presence of residual oxygen from prematurely spoiling the packaged meat products, desiccants or oxygen scavengers may be placed in the outer barrier bag prior to sealing.

Also, soaker pads may be placed within the trays 10 prior to placing the meat therein, in order to absorb the excess run off juices from the meat which may occur during periods of prolonged storage.

We have consistently found that measurements of the oxygen content within the outer barrier bag 26 just after sealing to be very low, typically failing within a range of between 30–50 ppm. Also, immediately after sealing the outer barrier bag 26, measurements of the oxygen content within the first enclosed region of the ventilated overwrapped tray (ie., the air space immediately surrounding the packaged meat product) are consistently found to be under 250 ppm. After a period of two to three minutes from the time that the barrier outer bag is sealed, the oxygen levels in both the greater volume of the outer barrier bag 26 and inside the ventilated overwrapped trays 10 stabilizes to a maximum equilibrium of about 250 ppm, after which the oxygen levels drop off significantly upon absorption by the meat.

The internal volume of the outer barrier bag 26 is preferably large enough to ensure an ample supply of carbon dioxide gas for preserving the packaged meat products without the outer barrier bag 26 being sucked inwardly any appreciable amount which could cause physical damage to the appearance of the ventilated overwrapped trays 10 contained therein. In other words, a sufficient additional volume of the carbon dioxide gas is provided within the surrounding interior volume of the barrier outer bag 26 so that the packaging does not distort or implode as the meat absorbs the carbon dioxide gas.

We have found that meat products packaged in accordance with the above described method to have a shelf life of up to ninety days and still bloom up to a desired fiery red color when removed from the outer barrier bag.

While we have illustrated and described the preferred embodiments of our invention, it is to be understood that these are capable of variation and modification, and we therefore do not wish to be limited to the precise details set forth, but desire to avail ourselves of such changes and alterations as fall within the purview of the following claims.

What is claimed is:

1. In combination with an oxygen barrier outer bag having an interior volume that is first evacuated of residual atmosphere and then filled with a preservation-enhancing gas, a retail case-ready packaging for fresh meat which is received within said barrier bag during storage, said packaging comprising:

a) a tray formed of a non-oxygen retaining material and having a base, opposed upstanding end walls, and opposed upstanding side walls and an outwardly projecting upper perimeter lip which extends in continuous fashion along upper free ends of said upstanding side and end walls, said side walls, end walls and base of said tray together defining an upwardly open hollow interior sufficient to receive a piece of meat of a specified cut therewithin;

b) a flexible web of clear plastic wrapping material surrounding said tray and meat to provide a plastic overwrapped tray having two enclosed regions, including:

i) a first enclosed region defined by a portion of said plastic wrapping material which spans across and covers said hollow interior of said tray; and ii) a second generally annular-shaped enclosed region defined by a perimeter overwrap portion of said plastic wrapping material which extends from said outwardly projected perimeter lip to said base;

c) first perforation means disposed along upper portions of said tray for allowing gas exchange between said first and second enclosed regions without clogging due to run-off juices from the meat or due to shifting of the meat within the tray; and d) second perforation means disposed in said plastic wrapping material to permit gas exchange between said second enclosed region and a region outside of said overwrapped tray.

2. The combination as defined in claim 1, wherein:

a) said first perforation means include holes provided along upper portions of said side and end walls of said tray; and b) said second perforation means include vertical slits disposed in said perimeter overwrap portion of said plastic wrapping material, said slits being substantially imperceptible to a casual observer.

3. A fresh meat packaging system for retail case-ready display of meat, the fresh meat packaging system comprising:

a) a tray formed of a non-oxygen retaining material and having a base, opposed upstanding end walls, and opposed upstanding side walls and an outwardly projecting upper perimeter lip which extends in continuous fashion along upper free ends of said upstanding side and end walls, said side walls, end walls and base of said tray together defining an upwardly open hollow interior sufficient to receive a piece of meat of a specified cut therewithin;

b) a flexible web of clear plastic wrapping material surrounding said tray and meat to provide a plastic overwrapped tray having two enclosed regions, including:

i) a first enclosed region defined by a portion of said plastic wrapping material which spans across and covers said hollow interior of said tray; and ii) a second generally annular-shaped enclosed region defined by a perimeter overwrap portion of said plastic wrapping material which extends from said outwardly projected perimeter lip to said base;

c) first perforation means disposed along upper portions of said tray for allowing gas exchange between said first and second enclosed regions without clogging due to run-off juices from the meat or due to shifting of the meat within the tray;

d) second perforation means disposed in said plastic wrapping material to permit gas exchange between said second enclosed region and a region outside of said overwrapped tray;

e) a sealable oxygen barrier outer bag for enclosing said plastic overwrapped tray, said oxygen barrier bag defining an enclosed volume surrounding said overwrapped tray for containing a sufficient amount of preservation-enhancing gas to prevent distorting or imploding of the packaging system as the meat absorbs the preservation enhancing gas.

4. The packaging system according to claim 3, wherein:

a) said first perforation means include holes provided along upper portions of said side and end walls of said tray; and b) said second perforation means include vertical slits disposed in said perimeter overwrap portion of said plastic wrapping material, said slits being substantially imperceptible to a casual observer.

5. The packaging system according to claim 3 which includes at least one oxygen scavenger disposed between said outer barrier bag and said overwrapped tray.

6. The packaging system according to claim 4 which includes at least one oxygen scavenger disposed between said outer barrier bag and said overwrapped tray.

7. The packaging system according to claim 3, which includes a soaker pad on said base of said tray.

8. The packaging system according to claim 4, which includes a soaker pad on said base of said tray.

9. The packaging system according to claim 5, which includes a soaker pad on said base of said tray.

10. A fresh meat packaging system for retail case-ready display of meat, the fresh meat packaging system comprising:

a) a tray formed of a non-oxygen retaining material and having a base, opposed upstanding end walls, and opposed upstanding side walls and an outwardly projecting upper perimeter lip which extends in continuous fashion along upper free ends of said upstanding side and end walls, said side walls, end walls and base of said tray together defining an upwardly open hollow interior sufficient to receive a piece of meat of a specified cut therewithin;

b) a flexible web of clear plastic wrapping material surrounding said tray and meat to provide a plastic overwrapped tray having two enclosed regions, including:

i) a first enclosed region defined by a portion of said plastic wrapping material which spans across and covers said hollow interior of said tray; and ii) a second generally annular-shaped enclosed region defined by a perimeter overwrap portion of said plastic wrapping material which extends from said outwardly projected perimeter lip to said base;

c) at least one opening disposed in a wall portion of said tray for allowing gas exchange between said first and second enclosed regions;

d) at least one opening disposed in said plastic wrapping material to permit gas exchange between said second enclosed region and a region outside of said overwrapped tray;

e) a sealable oxygen barrier outer bag for enclosing said plastic overwrapped tray, said oxygen barrier bag defining an enclosed volume surrounding said overwrapped tray for containing a sufficient amount of preservation-enhancing gas to prevent distorting or imploding of the packaging system as the meat absorbs the preservation enhancing gas.

11. The packaging system according to claim 10 which includes at least one oxygen scavenger disposed between said outer barrier bag and said overwrapped tray.

* * * * *